US005273178A

United States Patent [19]

Sandham

[11] Patent Number: 5,273,178

[45] Date of Patent: Dec. 28, 1993

[54] CLOSABLE CONTAINER

[75] Inventor: Roy William Sandham, Boksburg, South Africa

[73] Assignee: Eimco Mining Machinery (PTY) Limited

[21] Appl. No.: 50,728

[22] Filed: Apr. 20, 1993

Related U.S. Application Data

[63] Continuation of Ser. No. 838,105, Feb. 18, 1992, abandoned.

[30] Foreign Application Priority Data

Mar. 19, 1991 [ZA] South Africa ..... 91/2029

[51] Int. Cl.[5] ..... B65D 45/00

[52] U.S. Cl. ..... 220/318; 220/323; 220/328; 220/334

[58] Field of Search ..... 220/315, 318, 327, 328, 220/334, 343, 323

[56] References Cited

U.S. PATENT DOCUMENTS

| | | | |
|---|---|---|---|
| 309,938 | 12/1884 | Farnum | 220/328 X |
| 667,747 | 2/1901 | Taylor | 220/323 |
| 797,771 | 8/1905 | Heiser | 220/323 X |
| 1,465,110 | 8/1923 | Boggs | 220/328 X |
| 2,745,362 | 5/1956 | Lunde | 220/323 X |
| 3,774,670 | 7/1973 | DeFrees | 220/323 X |
| 4,057,170 | 11/1977 | Dougherty | 220/323 |

FOREIGN PATENT DOCUMENTS 897815 7/1990 South Africa .

OTHER PUBLICATIONS

Article—"Flameproof high technology switchgear from Genwest Industrials".

*Primary Examiner*—Allan N. Shoop
*Assistant Examiner*—Nova Stucker
*Attorney, Agent, or Firm*—Ladas & Parry

[57] ABSTRACT

The invention provides a closable container having an access opening closable by closure doors comprising preferably two hinged doors hingedly mounted on the container on opposed sides of the access opening, and a releasable locking mechanism for the doors. The locking mechanism includes a pair of T-shaped pressure plates hingedly mounted by means of hinge pins on opposed sides of the access opening, to be pivotally displaceable around axes disposed at right angles to the pivotal axes of the hinged doors, to a closed position in which they are positioned over the doors to overlap at least partially with the edges of each door. An engagement block with a handle is provided to hold the pressure plates and the doors in the closed position, the engagement block being rotatably displaceable from a disengaged position to an engaged position in which it engages the pressure plates to exert force on the plates so as to press the edge regions of the doors uniformly against the sides of the access opening.

13 Claims, 3 Drawing Sheets

CLOSABLE CONTAINER

This is a continuation of copending application Ser. No. 07/838,105 filed on Feb. 18, 1992.

This invention relates to closure means for a closable container of the type intended to be used to house electrical equipment such as switches, relays and the like, particularly but not necessarily exclusively intended for use in conditions where a flameproof container is required to prevent or at least retard the exit of a flame or explosion occurring therein. The invention extends also to a closable container provided with such closure means.

BACKGROUND OF THE INVENTION

In closable containers intended to be used to house electrical equipment in surroundings which may be regarded as fire hazardous, such as in mines, it is desired that the access doors to such containers should be capable of secure closure, in the sense that the edges of a door should provide an accurate fit with the surrounding wall areas along the entire length of the door edges. This is necessary to prevent the escape from such a container of sparks or flames capable of causing a conflagration outside the container should a fire or an explosion occur within the container. Such a continuous tight closing fit may be achieved by providing a plurality of securing means, such as bolts, at spaced intervals along the edges of a door. However, closure means of such a nature would be troublesome and time-consuming to open and close intentionally, eg for inspection purposes It has been proposed to provide a fireproof door for flameproof containers in which closure of the door is achieved by means of a locking handle pivoted about an eccentric axis. It is expected, however, that such an arrangement would in practice be subject to limitation as to the dimensions of the door which could effectively be closed in that manner with the required degree of accuracy. The overall dimensions of the container would likewise be limited.

It is an object of the invention to provide a closable container having access doors capable of secure closure so as to be suitable to be used as a flameproof housing for electrical equipment.

SUMMARY OF THE INVENTION

According to the invention there is provided closure means for a closable container having an access opening closable by means of such closure means, the closure means including a hinged door, and locking means for the door provided on the container in spaced relationship to the hinged side of the door, the locking means including a pressure member adapted to be positioned over at least part of an edge region of the door, and engagement means displaceable from a disengaged position in which it does not exert force on the pressure member, to an engaged position in which it engages the pressure member so as to exert force on said member to press the edge region of the door against the sides of the access opening.

The invention extends also to a closable container provided with closure means in accordance with the invention, which may be a container in the form of a free-standing separate unit or a part of a composite system or structure, and which may further be a container which will in use be stationary or which will be provided on mobile equipment. Accordingly, the description of the invention as set out herein should be understood to refer to closure means prior to assembly with a suitable container, as well as to a container fitted with such closure means.

The pressure member may comprise a pressure plate to be hingedly mounted on a wall of the container for pivotal displacement from an open position in which it is positioned away from the door, to a closed position in which it is positioned at least partially overlapping the door along one or more of its edges.

In one embodiment the closure means may be intended for an access opening of rectangular configuration, and the hinged door may be of rectangular configuration hinged along one side thereof, and the pressure plate may be of planar angled configuration, having elongated sections disposed substantially at right angles to one another, the pressure plate being adapted to be hingedly mounted on a wall of the container to be pivotally displaceable around an axis disposed at right angles to the pivotal axis of the hinged door, whereby the pressure plate may be positioned over the door after the door has been closed, to extend along at least part of two adjacent edge regions of the door remote from its hinged side, and so as to press those edge regions of the door against the surrounding wall areas of the access opening when it is engaged by the engagement means.

In a preferred embodiment, a closable container may be provided with closure means including two hinged doors hingedly mounted on opposed sides of the access opening, so that the doors may be opened and closed by pivotal movement in opposite directions. The pressure member may in this case be configured to extend along at least, the edges of both doors which are opposite to the hinged sides of the doors respectively, which two edges are arranged to be positioned adjacent one another when the doors are closed.

In this embodiment, with an access opening and two doors of rectangular configuration, two pressure plates may be provided both being of roughly T-shaped configuration, the plates having hinge connections on their transverse limbs to enable the plates to be hingedly mounted on the container on opposed sides of the access opening other than the sides on which the doors are mounted, so that the plates are pivotally displaceable on hinges operative on the transverse limbs of the plates around axes disposed at right angles to the pivotal axes of the doors, the arrangement being such that the pressure plates may be positioned over the doors after the doors have been closed, so that the angled configuration of the plates will overlap at least partially with the edges of each door on the three sides other than its hinged side. When the plates are engaged by the engagement means, each door will be pressed along its edges against the peripheral areas of the container walls surrounding the access opening.

It will be evident that closure means of this nature will ensure that the doors are pressed against the surrounding edges of the access opening along a substantial part of the door edges, to provide an accurate closing fit with the surrounding wall areas of the container.

In order to provide for more accurate and variable adjustment, the pressure plates may be provided with spacer means operative in a direction perpendicular to the plane of the plates, the spacer means for example being in the form of bolts extending through holes provided in suitably spaced positions in the plates, the bolts being so positioned that they will press against the peripheral areas of the hinged doors when the plates are in their closed position, whereby the bolts may be adjusted to ensure that the required force is exerted on the doors when the pressure plates are engaged in the closed position. If desired, the hinges by means of which the doors are mounted on the walls of the container may include brackets extending over the edges of the doors, and variable adjustment bolts may be provided on such brackets, the bolts being operative as spacer means adjustable in a direction perpendicular to the plane of the doors, whereby the pressure on the hinged edges of the doors when the doors are closed, may also be adjusted.

The engagement means for engaging the pressure plates so as to apply force to the doors may include an engagement member mounted on the container adjacent a door edge, preferably adjacent the edge of the door opposed to the hinged side of the door, the mounting being adapted to displace the engagement member to a first disengaged position in which it engages neither the door edge nor the pressure plates, and to a second engaged position in which it engages the pressure plates positioned over the door edges to exert force on the pressure plates to press the door edges against the peripheral areas of the container wall surrounding the access opening, as set out above.

The movement of the engagement member between the disengaged and the engaged positions may be rotational movement. For example, the engagement member may be of such configuration and may be so positioned and mounted that rotational displacement through 90 degrees will move it from the disengaged to the engaged position.

Where a pair of closure doors are provided, the container may be provided with a cross-member extending across the access opening from one side thereof to the opposite side, in a position intermediate of and parallel to the opposed sides of the access opening on which the closure doors are hingedly mounted, on which cross-member the engagement member may be rotatably mounted.

The engagement member may be an engagement block mounted on the cross-member by means of a shaft extending through the cross-member, the shaft being threaded along part of its length to permit the engagement block to be rotatably mounted thereon in such a manner, that rotation of the block on the threaded shaft through 90 degrees in one direction will cause the block to be displaced away from the pressure plates and the closure doors so as to release them, while rotation of the block on the shaft through 90 degrees in the opposite direction will cause the block to be displaced closer to the pressure plates and the closure doors so as to press the pressure plates against the doors thereby holding the doors in a snugly and tightly closed position. The engagement block may be of elongated shape, and may be of such dimensions that when it is positioned parallel to the cross-member, it will be located between the adjacent edges of the two closure doors, permitting the doors to be opened and closed, and thus being in the disengaged position. However, when the engagement block is rotated through 90 degrees to be positioned at right angles to the cross-member, it will extend over the adjacent edges of the two closure doors, thus being then in the engaged position.

The T-shaped pressure plates may in this case be formed with longitudinally extending slots in their upright limbs, within which slots the engagement block will be located when it is in the disengaged position, so that the pressure plates may be displaced from their closed to their open positions and vice versa. However, when the engagement block is moved to its engaged position, it will extend transversely across the said longitudinal slots to engage and hold the pressure plates in the closed position.

It will be evident that the engagement block should be mounted on the cross-member in spaced relationship thereto, to permit the peripheral area of the closure doors along their edges remote from the hinged sides, as well as the pressure plates to be positioned within the space between the cross-member and the engagement block. By adjusting the dimensions of the space between the engagement block and the cross-member, the doors and pressure plates may thus be pressed in accurate closing fit against the cross-member and against the wall areas surrounding the access opening by means of the engagement block. The space may be adjusted by adjusting the position of the block on the threaded mounting shaft.

Alternatively or in addition, the engagement block may, like the pressure plates, be provided with spacer bolts in suitable positions, the spacer bolts being adjustable in a direction perpendicular to the plane of the pressure plates when the latter are in the closed position, thus constituting adjustment means whereby the force exerted by the engagement block on the pressure plates and the closure doors may be varied, to ensure that the pressure plates and doors are pressed against the cross-member and the wall areas surrounding the access opening in the desired accurate closing fit.

The engagement block may be provided with a handle by means of which the block may be gripped to displace it from the open to the closed position and vice versa. The handle may conveniently be of handlebar configuration, having two arms with handle grips extending laterally in opposite directions, so that the two handle grips may be gripped with two hands to twist-turn the engagement means between the open and the closed positions, with a quick-locking and quick-release action. It will be appreciated that a handle bar with arms of some length will enable greater force to be applied to turn the engagement block.

At least the inside peripheral areas of the closure doors, and the outside peripheral areas of the container walls surrounding the access opening may advantageously be machined with precision, so as to provide an accurate closing fit. The arrangement may be such that when the closure doors are closed, gaps with a controlled width of not greater than about 0.4 mm will be provided between the closure doors and the walls of the container surrounding the access opening, to act as flamepaths to permit controlled exit of gases and vapours and even flames should a fire or explosion occur within the container.

Because the closure and locking means according to the invention allows two closure doors of smaller size to be used instead of one larger door to close an access opening of predetermined dimensions, the entire inside face of the doors may be machined, instead of only the peripheral areas along the edges of the doors. The formation of the flamepaths may thus be more accurately controlled.

Furthermore, because two closure doors are provided, closable containers of large size may be provided, having access openings of convenient dimensions to facilitate access to and inspection of and/or maintenance work on electrical equipment accommodated inside.

According to yet another feature of the invention, one or both closure doors may be provided with an inspection window. The inspection windows may comprise reinforced glass panes mounted within inspection openings provided in the doors, by means of surrounding metal plate surrounds.

The container may be of box-like configuration, and may be made of steel, with the access opening provided in the front wall, the access opening being closable by closure means in accordance with the invention.

DESCRIPTION OF THE DRAWINGS

The invention and the manner in which it may be put into practice will now be described by way of example, with reference to the accompanying diagrammatic drawings, in which.

DETAILED DESCRIPTION

According to the invention there is provided a closable container intended to house electrical equipment in surroundings which may be regarded as fire hazardous, such as in mines, where it is desired that the access doors when closed should accurately and snugly fit against the surrounding wall areas along the entire length of the door edges, to prevent escape from such container of sparks or flames capable of causing a conflagration, in the event of a fire or explosion occurring within, and caused by the electrical equipment housed in the container.

Figure 3:
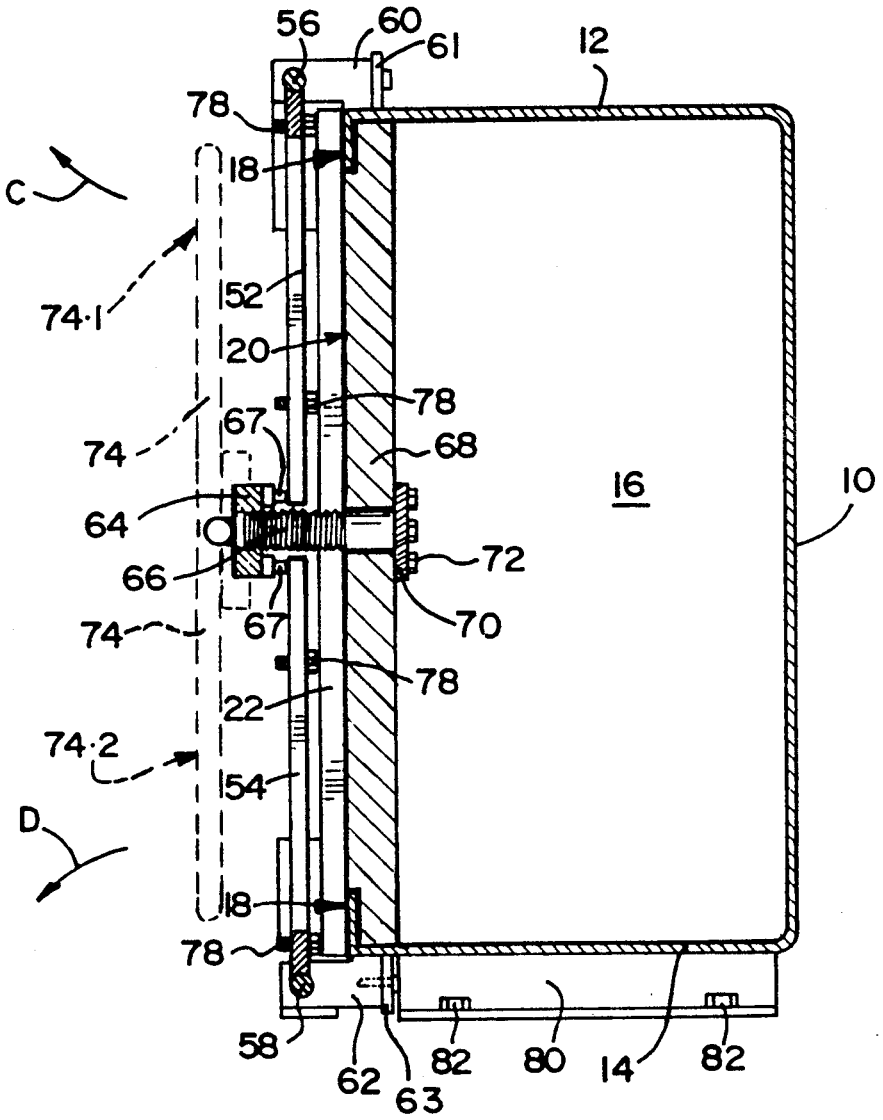
FIG. 3 is a cross-sectional view through the container, taken along line III—III in FIG. 1, and depicting in broken lines the engagement means in the disengaged position.

The container may conveniently be of box-like construction, having a back wall 10, top wall 12, bottom wall 14, and side walls 16. The container is preferably made of steel. An access opening 20 of rectangular configuration is provided on the front side of the container, forwardly directed surrounding areas 18 being provided by the wall area surrounding the opening 20, as depicted in FIG. 3.

The access opening 20 is closable by means of two closure doors 22, 24 which are hingedly mounted on opposing sides of the access opening 20, as shown at 26, 28 by means of hinge rods 30, 32 supported in hinge bearings 34, 36 mounted on the walls of the container by means of brackets 33 and bolts 35. Hinge plates 38, 40 secured to the doors 22, 24 by means of bolts 39, 41 incorporate hinge bearings 38.1, 40.1 within which the hinge rods 30, 32 rotate. As will be evident, the doors 22, 24 are arranged to be opened by pivotal movement in opposite directions, as shown by arrows A and B in FIG. 1.

The doors 22, 24 are provided with inspection windows 42, 44 comprising reinforced glass panels 43, 45 mounted on the doors 22, 24 by means of surrounding metal plates 46, 48 secured to the doors by bolts 50.

Figure 1:
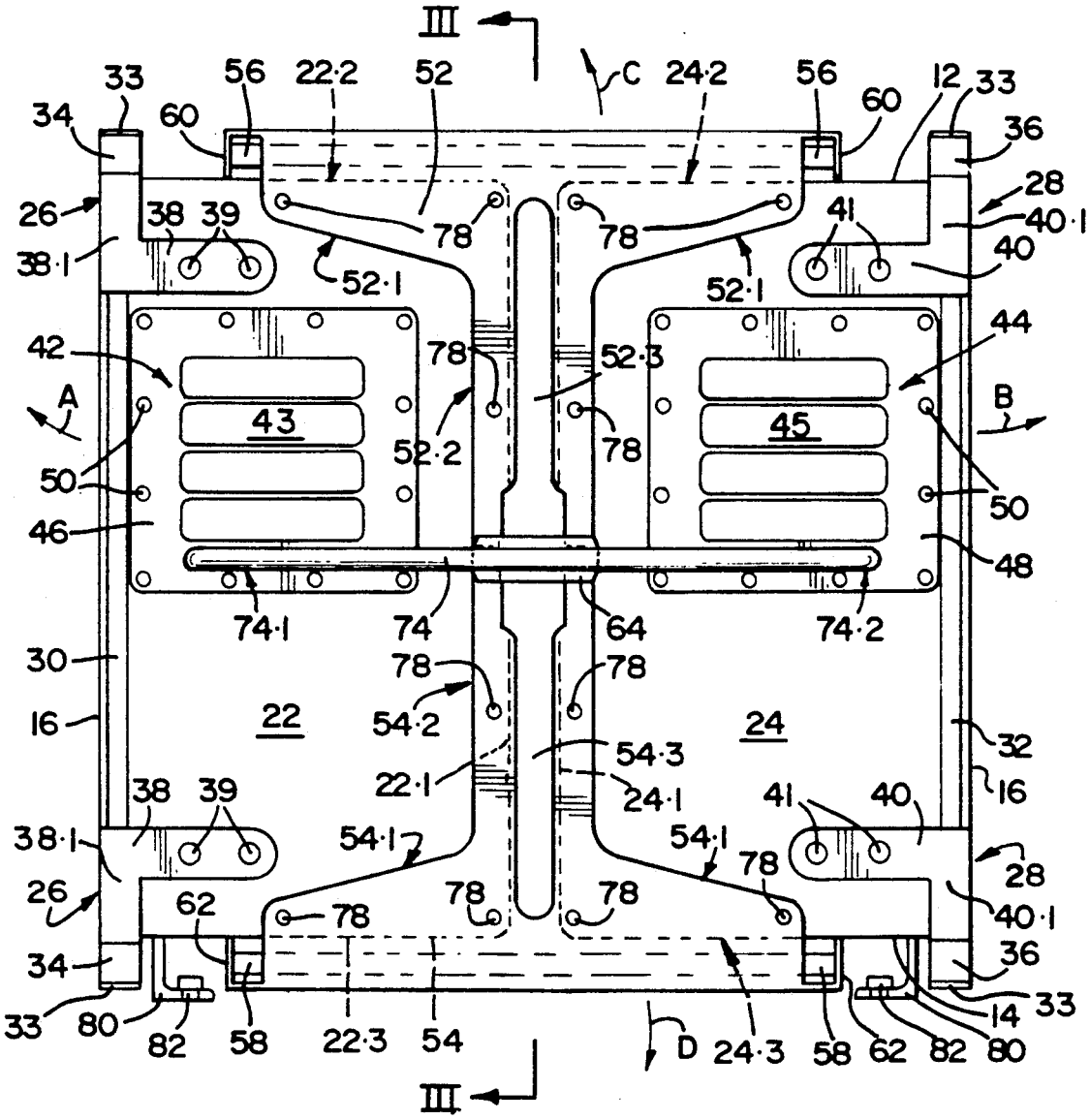
FIG. 1 is a diagrammatic outside elevation of the front side of a closable container in accordance with the invention, provided with two closure doors, and depicting the closure doors, pressure plates and the engagement means in the closed and locked position.

As explained above, it is necessary for the doors 22, 24 when closed to provide an accurate fit against the surrounding wall areas 18 of the container, along the length of the door edges. This is achieved by providing a pair of symmetrical pressure plates 52, 54, which can be positioned over the edges of the doors 22, 24 remote from the hinged sides of the doors, and by means of which force may be exerted on the door edges, as explained below. The pressure plates 52, 54 are of substantially T-shaped configuration, as illustrated in FIG. 1, having transverse arms 52.1, 54.1 and upright limbs 52.2, 54.2. The pressure plates 52, 54 are hingedly mounted on opposed sides of the access opening other than the sides on which the doors 22, 24 are hinged, by means of hinge pins 56, 58 mounted on the transverse limbs 52.1, 54.1 and on hinge supports 60, 62 which in turn are secured to the top wall 12 and bottom wall 14 of the container respectively by means of brackets 61, 63. The upright limbs 52.2, 54.2 of the pressure plates 52, 54 are provided with longitudinally extending slots 52.3, 54.3 for a purpose to be explained below.

The container is supported on angled support brackets 80 extending from front to back along the bottom edges of the side walls 16. The container may be bolted to the floor or to any suitable base or unit by means of bolts 82 extending through the support brackets 80. The support brackets 80 have the further function of positioning the container at an elevation relative to the floor or other base, so as to provide the necessary space for the hinge mechanism 58, 62 of the pressure plate 54 and the bottom hinge bearings 34, 36 of the doors 22, 24 to function without impediment.

Figure 2:
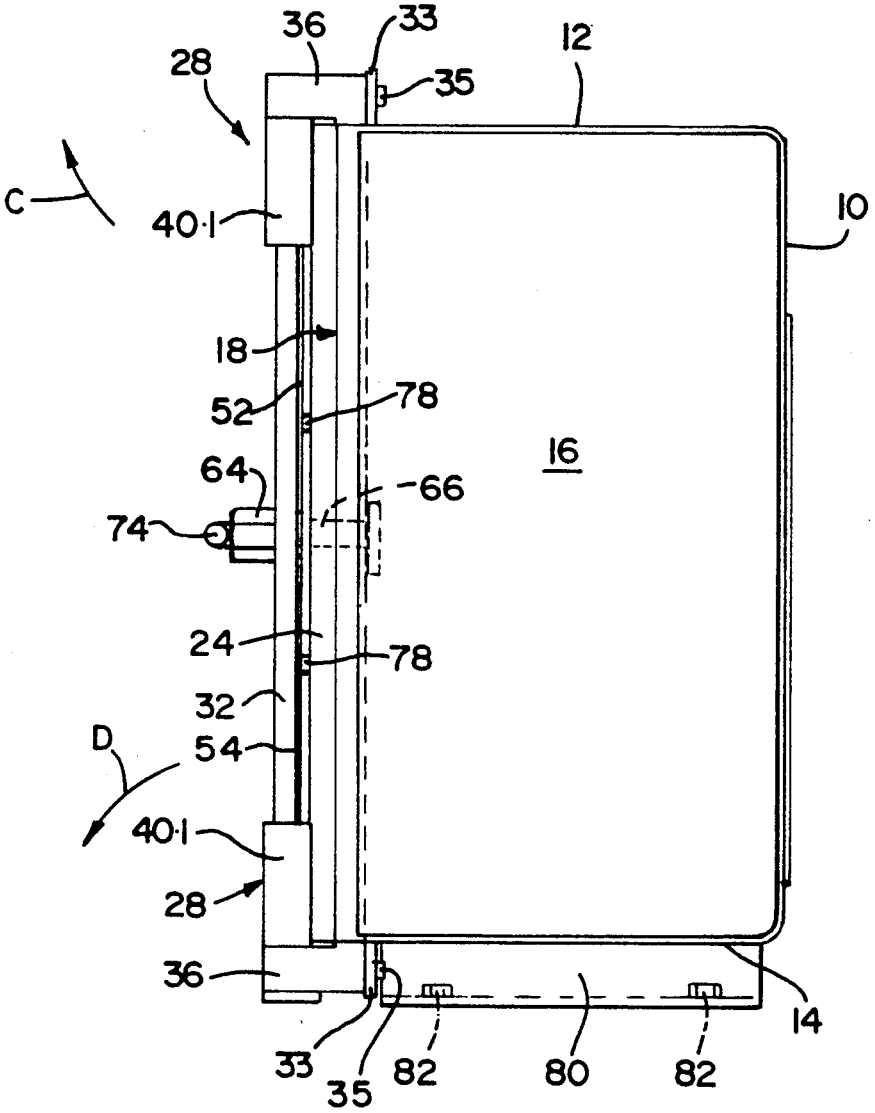
FIG. 2 is a diagrammatic outside side elevation of the closable container of FIG. 1.

The pressure plates 52, 54 are arranged to open in opposite directions, as shown by the arrows C and D in FIGS. 1, 2 and 3. When the doors 22, 24 are closed, and the pressure plates 52, 54 are also pivoted inwardly into the closed position as depicted in the drawings, it will be apparent that the T-shaped angled configuration of the pressure plates 52, 54 will enable the plates to overlap with the edges 22.1, 24.1 of the doors 22, 24 remote from their hinged sides, as well as with part of their edges 22.2, 22.3 and 24.2, 24.3 adjacent the said remote edges. The pressure plates 52, 54 will thus be able to press the doors 22, 24 into a tightly closed condition along the greater part of their edges, when the pressure plates are engaged by engagement means as described below.

Engagement means is provided which includes an engagement block 64 of elongated shape, rotatably mounted on a threaded shaft 66 which is in turn mounted on a cross-member 68 extending across the access opening 20 from the top wall 12 to the bottom wall 14, by means of a plate 70 fast with one end of the shaft 66 and bolts 72.

The engagement block 64 is provided with a handle 74 which is shaped like a handle bar having two handle grips 74.1, 74.2 extending laterally and by means of which the handle may be gripped by two hands to displace it from the engaged to the disengaged position or vice versa, as explained below.

The engagement block 64 is rotatably displaceable on the threaded shaft 66 between a first disengaged position shown in broken lines in FIG. 3, and a second engaged position as shown in full lines in FIGS. 1, 2 and 3. In the disengaged position as shown in FIG. 3, the block 64 and handle 74 are disposed substantially parallel to and between the remote edges 22.1, 24.1 of the doors 22, 24 and within the longitudinal gaps 52.3, 54.3 of the pressure plates 52, 54. When in that position, the engagement means permits the pressure plates 52, 54 to be swung open in the direction of the arrows C and D, and the doors 22, 24 to be swung open in the direction of the arrows A and B, so that access to the interior of the container may be gained.

To close the container, the doors 22, 24 are first closed, then the pressure plates 52, 54 are brought to the closed position as depicted in FIG. 1. This will be possible if the engagement block 64 and the handle 74 are located in the disengaged position, i.e. substantially upright, between and parallel to the door edges 22.1, 24.1 and within the gaps 52.3, 54.3 of the pressure plates 52, 54. Finally the engagement block 64 and handle 74 are twisted through 90 degrees, to the engaged position as depicted in FIG. 1. As illustrated in FIG. 3 on an exaggerated scale, the rotational displacement of the engagement block 64 on the threaded shaft 66 to the open position, will cause the block 64 to be displaced further away from the doors 22, 24 and the pressure plates 52, 54 so as to release the pressure on the doors and the pressure plates. However, rotational displacement of the block 64 on the threaded shaft 66 to the closed position, will cause the engagement block 64 to be displaced closer to the doors 22, 24 and the pressure plates 52, 54 so as to exert force on the pressure plates and thus on the doors. Spacer bolts 67 are provided on the engagement block 64, the spacer bolts 67 being adjustable in a direction perpendicular to the pressure plates 52, 54, thus constituting adjustment means whereby the force exerted on the pressure plates 52, 54 by the engagement block 64 may be adjusted.

It will be apparent that the engagement block 64 will thus engage with and press against the pressure plates 52, 54 to hold the plates 52, 54 and the doors 22, 24 in a closed position. By pressing on the pressure plates 52, 54 the engagement block 64 causes the pressure plates 52, 54 to press the doors 22, 24 against the adjacent wall areas 18 surrounding the access opening of the container, in a tight closing fit.

In order to ensure that such tight and accurate fit is achieved, the outer faces 18 of the adjacent wall areas are preferable machined, and the peripheral areas of the inner faces of the doors 22, 24 or the entire inside faces of the doors 22, 24 are likewise machined to the required degree of smoothness. Since the doors in a two-door system as provided by the invention are smaller in size than a single door would have been, it may in practice be possible and indeed advantageous to machine the entire inside faces of the doors 22, 24 to the required degree of smoothness.

According to a further feature of the invention, and to provide for adjustment of the pressure brought to bear on the peripheral areas of the doors 22, 24 by the pressure plates 52, 54, adjustable bolts 78 may be provided in suitably spaced positions on the pressure plates 52, 54, the bolts extending through the pressure plates to press on the doors 22, 24 as shown in FIG. 3. The bolts 78 are preferably so positioned that they will press on the peripheral areas of the doors 22, 24 in the vicinity of the edges of the doors, to ensure accurate closure.

The reason why accurate closure is important, is that controlled flamepaths are preferably provided between the outer face of the adjacent wall areas 18 surrounding the access opening and the inner faces of the doors 22, 24 to permit a controlled exit of gases and vapours and even some flames should an explosion or fire occur inside the container and the pressure become too high. The dimensions of these flamepaths have to be accurately controlled, so that the escaping gases, vapours and flames will be retarded to a point where conflagration on the outside will no longer take place. The gap width of a flamepath should preferably not exceed about 0.4 mm. The Applicant believes that the closure means provided by its invention enables such accurate closure to be achieved, with flamepaths the dimensions of which can be accurately controlled along the length of the door edges.

Furthermore, because the closure means according to the invention comprises two separately hinged doors, a flameproof closable container of larger dimensions may be provided, in which the individual doors are nevertheless not too heavy to be handled manually.

I claim:

1. The combination of a closable container having walls and an access opening and a closure means for closing said access opening, the closure means including two hinged doors each door comprising a panel having peripheral edge regions, the doors being hingedly mounted by hinge means provided on the container on opposed sides of the access opening, the hinge means providing pivotal axes so that the doors can be opened and closed by pivotal movement in opposite directions about the said pivotal axes, and locking means for the doors provided on the container in spaced relationship to the hinge means for the doors, the locking means including a pressure means comprising at least one pressure plate hingedly mounted on the container for pivotal displacement about an axis disposed at a right angle to the pivotal axes of the hinge means of the doors, from an open position in which the said pressure plate is positioned away from the doors, to a closed position in which it overlaps the doors, the said pressure plate being of angled configuration having elongated sections disposed in angular relationship to one another so that when the pressure plate is in the said closed position its elongated sections will extend along and overlap at least part of the said peripheral edge regions of each of the doors, and engagement means displaceable from a disengaged position in which the said engagement means does not exert force on the pressure plate to an engaged position in which the said engagement means engages the pressure plate and exerts force on the pressure plate;

the arrangement being such that when the doors are closed and the pressure plate is in the aforesaid closed position and the pressure plate is engaged by the engagement means, the said pressure plate will press the said overlapped part of the said peripheral edge regions of the doors against wall areas of the container walls surrounding the access opening to provide an accurate closing fit.

2. The combination according to claim 1, in which the said access opening of the container and the said hinged doors are of rectangular configuration with each door having four sides defining four said peripheral edge regions, and in which the pressure means comprises two pressure plates each being of roughly T-shaped configuration having an elongated transverse section and an elongated upright section, the pressure plates having hinge connections on their transverse sections and being hingedly mounted on the container on opposed sides of the access opening being sides other than the sides on which the doors are mounted, so that the said pressure plates are pivotally displaceable on the hinge connections around pivotal axes disposed at right angles to the pivotal axes of the hinge means of the doors;

the arrangement being such that when the doors are closed and the pressure plates are in the aforesaid closed position the transverse and the upright sections of the two pressure plates together will overlap at least partially with three of the said four peripheral edge regions of each door.

3. The combination according to claim 2, in which the said pressure plates are each provided with spacer means operative in a direction perpendicular to the plane of each pressure plate, the spacer means being in the form of variable adjustment bolts extending through holes provided in suitably spaced positions in each pressure plate, the bolts being so positioned that they will press against at least part of the said peripheral edge regions of the hinged doors when the pressure plates are in the aforesaid closed position and engaged by the engagement means.

4. The combination according to claim 2, in which the said hinge means of the doors include brackets extending over at least part of the said peripheral edge regions of each door, and in which variable adjustment bolts are provided on each of the said brackets, the bolts being operative as spacer means and being adjustable in a direction perpendicular to the plane of each door, to enable force exerted by the brackets on the said peripheral edge regions of the doors when the doors are closed, to be adjusted.

5. The combination according to claim 2, in which the container is provided with a cross-member extending across the access opening from one side of the opening to the opposite side, in a position intermediate of and arranged parallel to the opposed sides of the access opening on which the doors are hingedly mounted, and in which the engagement means includes an engagement member mounted on the cross-member in a position adjacent a said peripheral edge region of each door remote from the hinge means of each door, by means of a mounting means which allows displacement of the engagement member to a first disengaged position in which the engagement member engages neither of the doors nor the pressure plates, and to a second engaged position in which the engagement member engages the pressure plates when the pressure plates are in the aforesaid closed position overlapping the doors, to exert force on the said pressure plates to press the said peripheral edge regions of the doors against wall areas of the container walls surrounding the access opening.

6. The combination according to claim 5, in which the engagement member is in the form of an engagement block mounted on the said cross-member by means of a shaft extending through the cross-member, the shaft being threaded along part of its length to permit the engagement block to be rotatably mounted thereon in such a manner, that rotation of the engagement block on the threaded part of the shaft through 90 degrees in one direction will cause the engagement block to be displaced away from the said pressure plates and the doors to the aforesaid disengaged position, while rotation of the engagement block on the threaded part of the shaft through 90 degrees in the opposite direction will cause the engagement block to be displaced closer to the pressure plates into the aforesaid engaged position.

7. The combination according to claim 6, in which the engagement block is of elongated shape and of such dimensions that when the engagement block is positioned parallel to the cross-member, it is in the aforesaid disengaged position and is located between and free from contact with the doors, permitting the doors to be opened and closed; and when the engagement block is rotated through 90 degrees to be positioned at a right angle to the cross-member, it is in the aforesaid engaged position and extends over peripheral edge regions of both the doors, preventing opening and closing of the doors.

8. The combination according to claim 7, in which the said pressure plates are each formed with an elongated slot in the upright section of each pressure plate, the slots extending longitudinally relative to the said elongated upright section; the arrangement being such that when the engagement block is in the aforesaid disengaged position, it will be located within the said elongated slots, so that the pressure plates are free to be displaced from their aforesaid closed to their aforesaid open positions and vice versa; and when the engagement block is in the aforesaid engaged position, it will extend transversely across the said elongated slots to engage and hold the pressure plates in the closed position.

9. The combination according to claim 8, in which the said engagement member is provided with spacer bolts in suitable positions, the spacer bolts being adjustable in a direction perpendicular to the plane of the said pressure plates when the latter are in the aforesaid closed position, to constitute adjustment means whereby force exerted by the engagement member on the pressure plates and the doors may be adjusted.

10. The combination according to claim 8, in which the said engagement member is provided with a handle by means of which the said engagement member is gripped to displace it from its aforesaid disengaged position to its aforesaid engaged position and vice versa, the handle having two arms with handle grips, the arms extending in opposite directions; the arrangement being such that the two handle grips may be gripped with two hands to twist-turn the engagement member between the aforesaid disengaged position and the aforesaid engaged position, with a quick-release and quick-locking action.

11. The combination according to claim 1, in which each said door panel has an inside face defining inside peripheral areas, and in which at least the said inside peripheral areas of the doors are machined with precision, to provide an accurate closing fit of the doors against wall areas surrounding the access opening.

12. The combination according to claim 11, in which the said wall areas of the container walls surrounding the access opening are machined with precision, to provide an accurate closing fit of the doors against the said wall areas, the arrangement being such that when the doors are closed, gaps with a controlled gap width of not greater than about 0.4 mm are provided between the said machined inside peripheral areas of the doors and the said machined wall areas of the container walls surrounding the access opening, to act as flamepaths to permit controlled exit of gases and vapours in the event of a fire or explosion within the container.

13. The combination according to claim 12, which constitutes a flame-proof container intended to house electrical equipment.

* * * * *